US011806738B1

(12) United States Patent
Kyees

(10) Patent No.: US 11,806,738 B1
(45) Date of Patent: Nov. 7, 2023

(54) DOOR PAINTING ASSEMBLY

(71) Applicant: Terry Kyees, Westerville, OH (US)

(72) Inventor: Terry Kyees, Westerville, OH (US)

( * ) Notice: Subject to any disclaimer, the term of this patent is extended or adjusted under 35 U.S.C. 154(b) by 0 days.

(21) Appl. No.: 17/867,773

(22) Filed: Jul. 19, 2022

(51) Int. Cl.
*B05B 13/02* (2006.01)

(52) U.S. Cl.
CPC ..... *B05B 13/0285* (2013.01)

(58) Field of Classification Search
CPC ..... Y10S 269/905
See application file for complete search history.

(56) References Cited

U.S. PATENT DOCUMENTS 4,993,708 A * 2/1991 Prosser ..... A63B 69/0075 473/417
5,090,648 A 2/1992 Wood, IV
5,164,011 A 11/1992 Ray
7,798,095 B2 9/2010 Navarro
7,870,834 B1 1/2011 Cundiff
8,066,267 B2 11/2011 Schaerer
8,707,976 B2 4/2014 Bauer
2007/0278363 A1 12/2007 Klippel

FOREIGN PATENT DOCUMENTS

GB 2557919 7/2018

* cited by examiner

*Primary Examiner* — Charles Capozzi

(57) ABSTRACT

A door painting assembly includes a tripod that is positionable on a horizontal support surface such that the tripod is vertically oriented. A shock absorber is slidably integrated into the tripod and the shock absorber is positionable at an adjustable height on the tripod. An armature is attached to the shock absorber thereby facilitating the armature to be positioned at an adjustable height on the tripod. The armature has a gripping element to engage the door to retain the door in a vertical orientation. In this way the armature facilitates a front of the door and a back of the door to be painted without having to reposition the door. The shock absorber absorbs vibration from the door resulting from the force of paint from a pressurized spray gun thereby inhibiting the tripod from is affected by the vibration.

7 Claims, 7 Drawing Sheets

DOOR PAINTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention

The disclosure relates to painting devices and more particularly pertains to a new painting device for holding a door in a vertical orientation for painting the door. The device includes a tripod and armature attached to the tripod which extends over the door and engages the door to hold the door in a vertical orientation. The device includes a shock absorber that is attached to the armature for absorbing vibration from spraying the door with paint.

(2) Description of Related Art Including Information Disclosed Under 37 CFR 1.97 and 1.98

The prior art relates to painting devices including A door stand including a base frame, an armature attached to the base frame and a pair of holders which each engage a door. The prior art discloses a door holder having a base frame, an armature attached to the base frame and a pair of pivots engaging a door to facilitate the door to be rotated about a vertical axis. The prior art discloses a door holder which includes a base member to engages a bottom edge of a door and an armature that engages a lateral edge of a door. The prior art discloses a pair of tripods that each engages a respective top edge and a bottom edge of a door to facilitate the door to be rotated about a horizontal axis for painting the door.

BRIEF SUMMARY OF THE INVENTION

An embodiment of the disclosure meets the needs presented above by generally comprising a tripod that is positionable on a horizontal support surface such that the tripod is vertically oriented. A shock absorber is slidably integrated into the tripod and the shock absorber is positionable at an adjustable height on the tripod. An armature is attached to the shock absorber thereby facilitating the armature to be positioned at an adjustable height on the tripod. The armature has a gripping element to engage the door to retain the door in a vertical orientation. In this way the armature facilitates a front of the door and a back of the door to be painted without having to reposition the door. The shock absorber absorbs vibration from the door resulting from the force of paint from a pressurized spray gun thereby inhibiting the tripod from is affected by the vibration.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
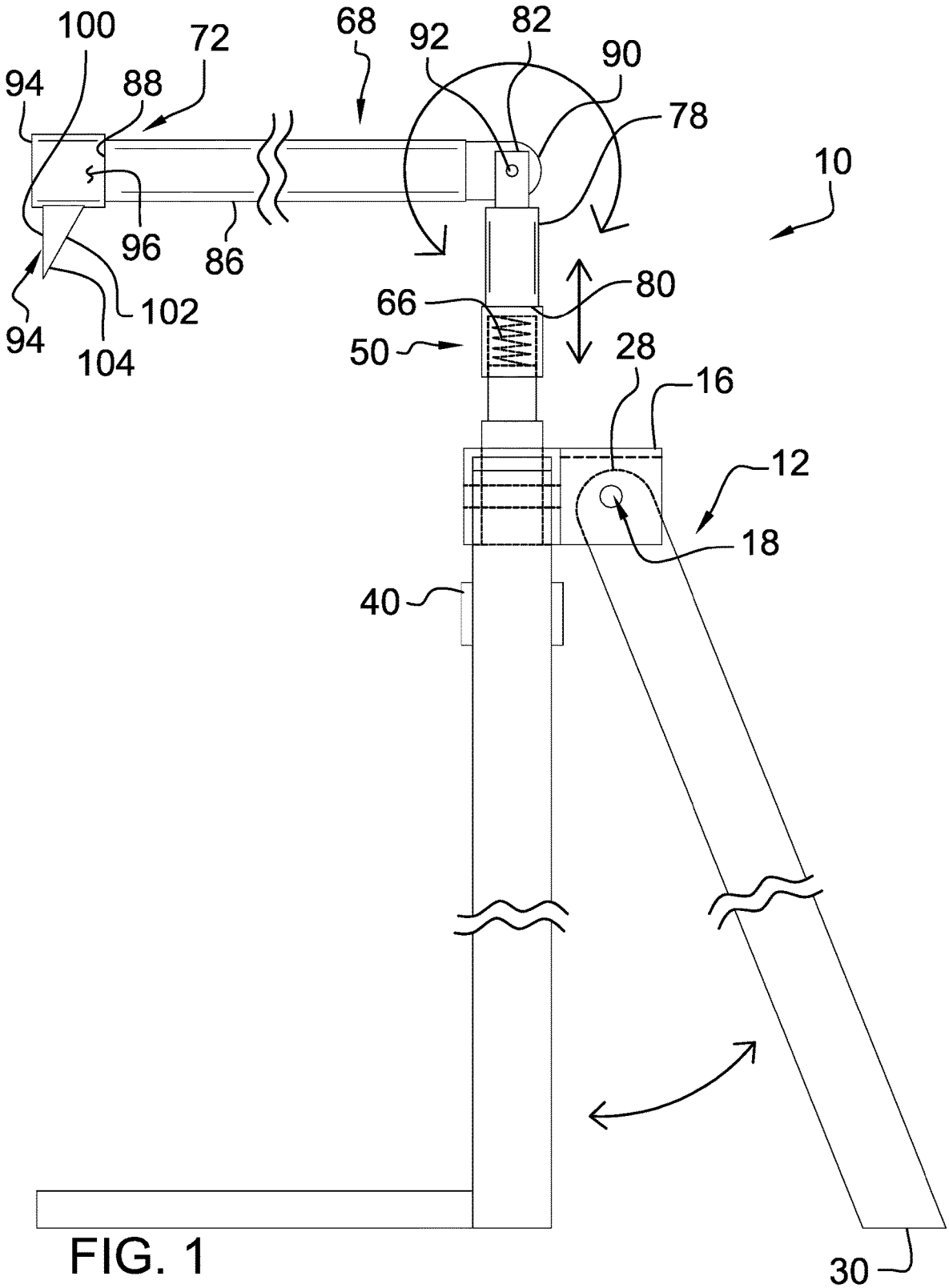
FIG. 1 is a left side view of a door painting assembly according to an embodiment of the disclosure.
Figure 2:
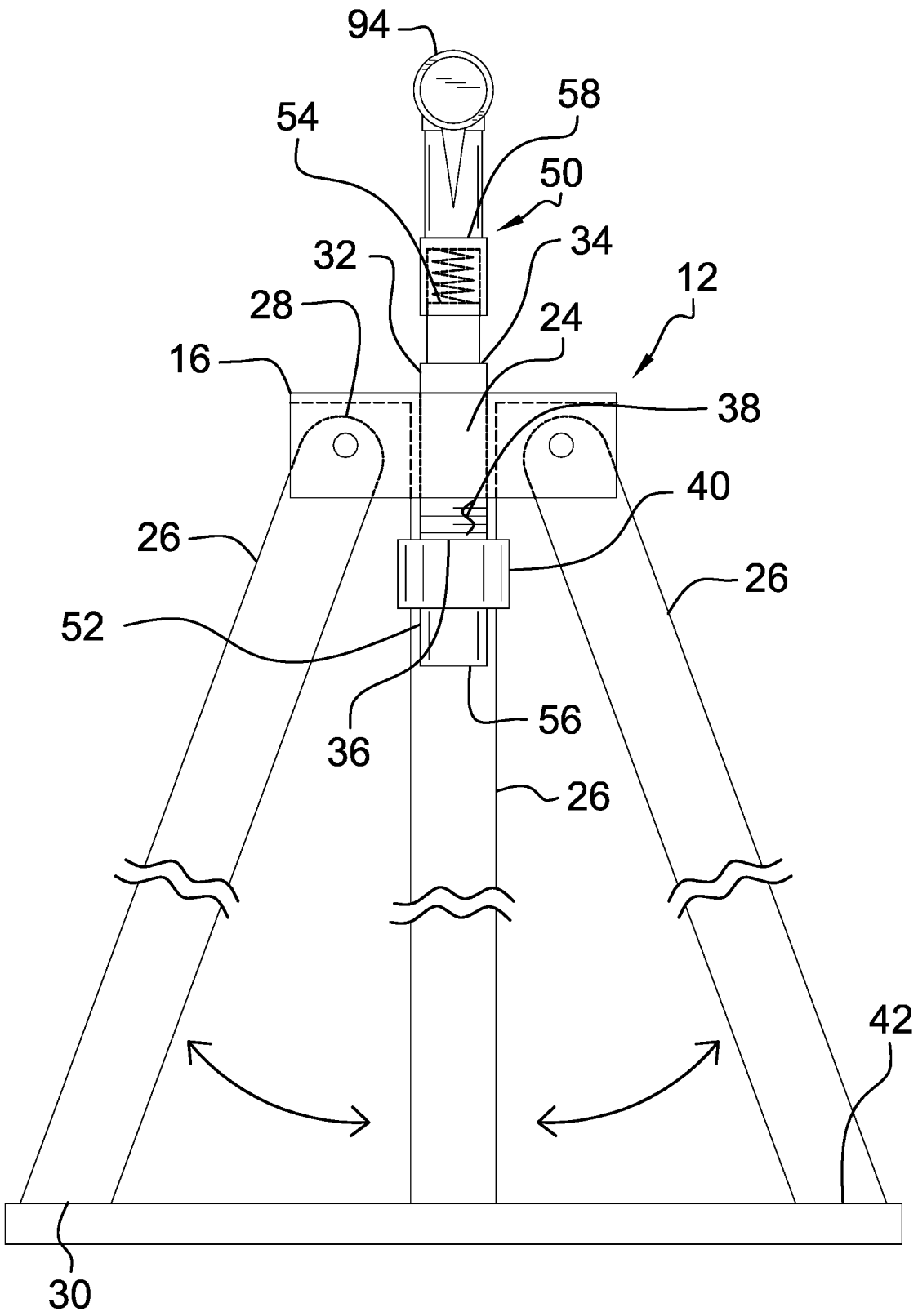
FIG. 2 is a front view of an embodiment of the disclosure.
Figure 3:
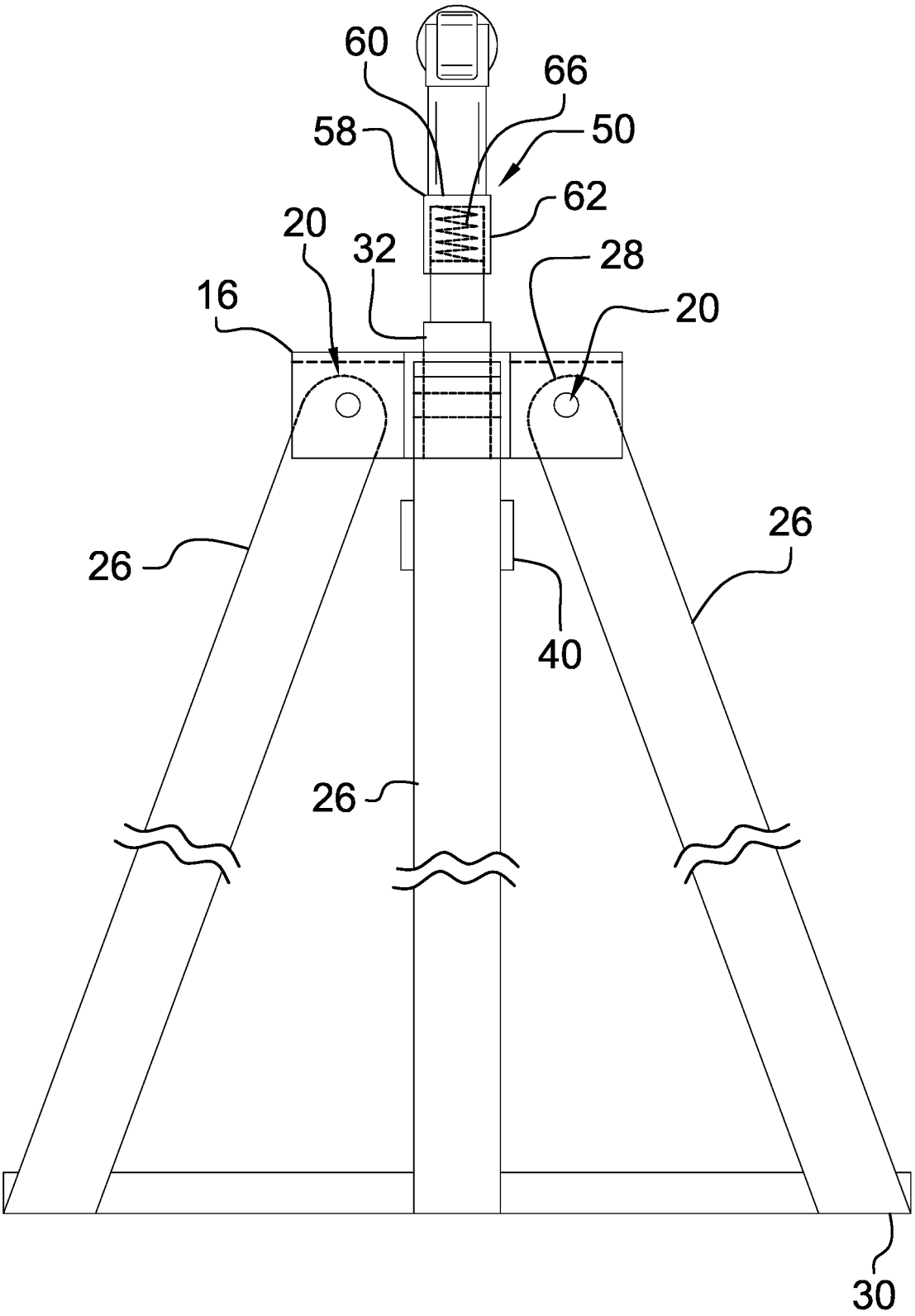
FIG. 3 is a back view of an embodiment of the disclosure.
Figure 4:
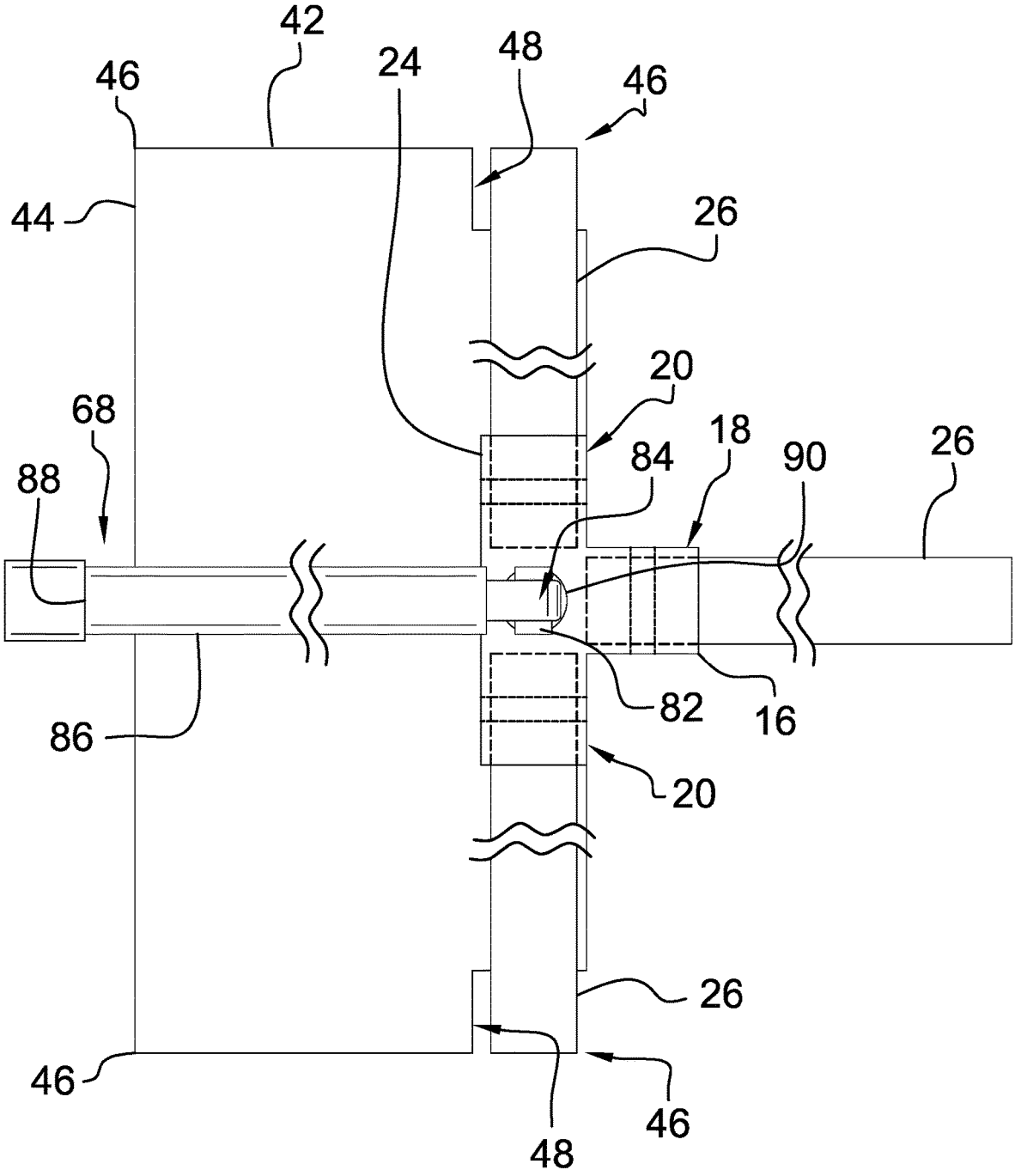
FIG. 4 is a top view of an embodiment of the disclosure.
Figure 5:
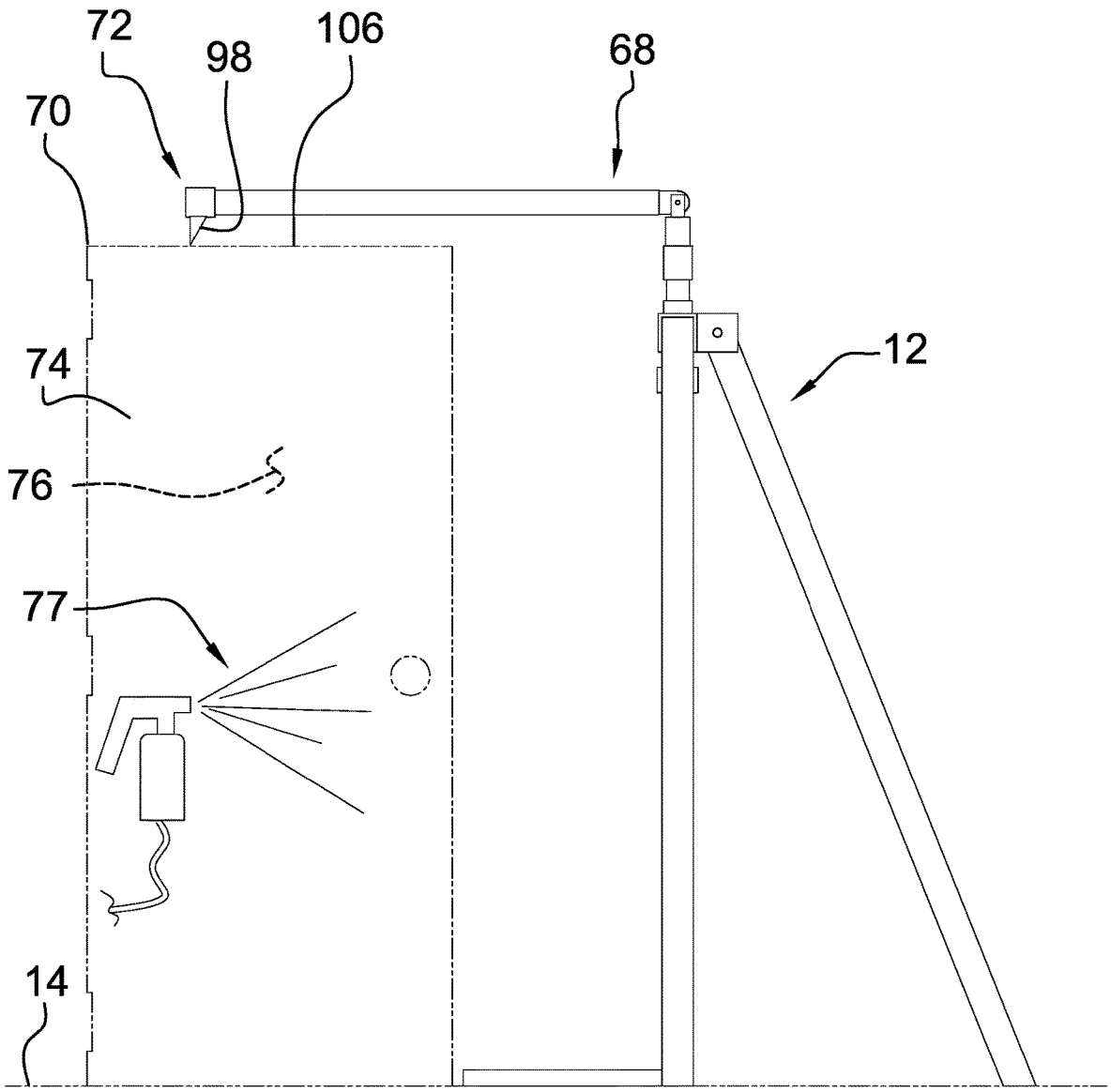
FIG. 5 is a perspective in-use view of an embodiment of the disclosure.
Figure 6:
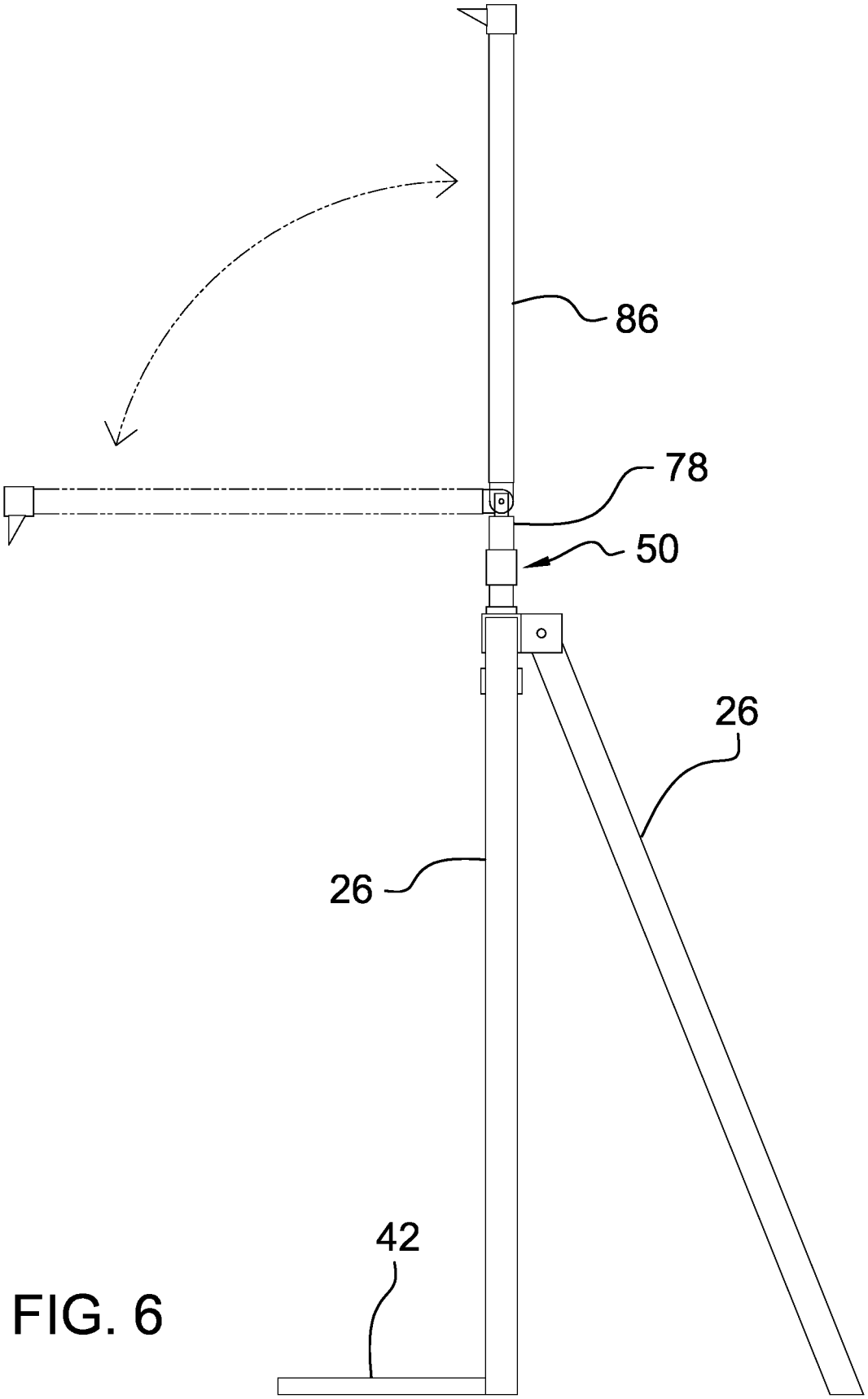
FIG. 6 is a left perspective view of an embodiment of the disclosure showing a pole being positioned between a deployed position and a stored position.
Figure 7:
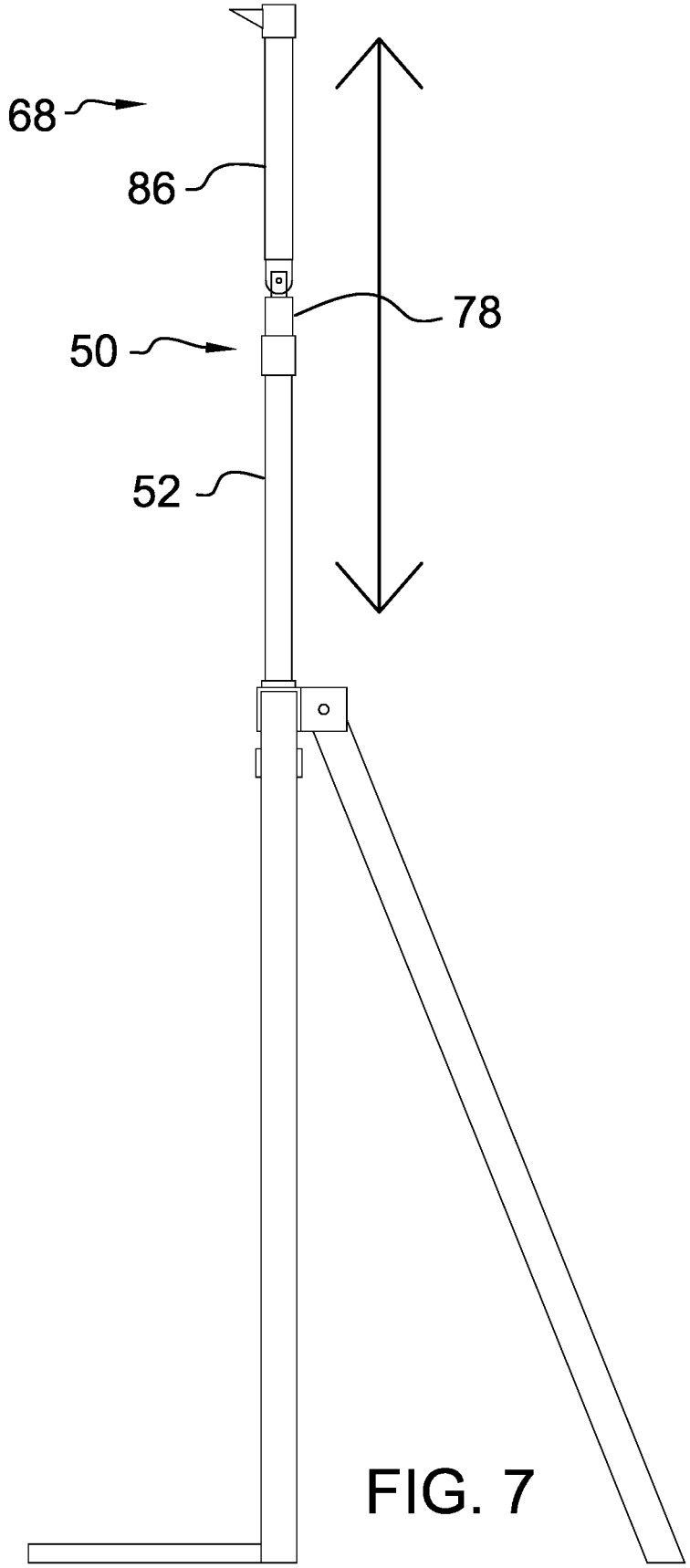
FIG. 7 is a left perspective view of an embodiment of the disclosure showing a shock absorber being raised.

With reference now to the drawings, and in particular to FIGS. 1 through 7 thereof, a new painting device embodying the principles and concepts of an embodiment of the disclosure and generally designated by the reference numeral 10 will be described.

As best illustrated in FIGS. 1 through 7, the door painting assembly 10 generally comprises a tripod 12 that is positionable on a horizontal support surface 14 such that the tripod 12 is vertically oriented. The tripod 12 comprises a hinge body 16 that has a plurality of hinge points 18 extending away from a center of the hinge body 16. The plurality of hinge points 18 includes a pair of lateral hinge points 20 and a rear hinge point 22. Each of the lateral hinge points 20 is aligned with a front face 24 of the hinge body 16. The rear hinge point 22 is centrally positioned between the lateral hinge points 20 and the rear hinge point 22 extends away from the pair of lateral hinge points 20.

The tripod 12 includes a plurality of legs 26 and each of the legs 26 has an upper end 28 and a lower end 30. The upper end 28 of each of the legs 26 is pivotally engaged to a respective one of the hinge points 18 on the hinge body 16. Each of the legs 26 is positionable in a deployed position having each of the legs 26 angling outwardly from the respective hinge point 18. Conversely, each of the legs 26 is positionable in a stored position having each of the legs 26 extending downwardly from the respective hinge point 18.

The tripod 12 includes a tube 32 that has an upper end 34, a lower end 36 and an outer surface 38 extending between the upper end 34 and the lower end 36 of the tube 12. The outer surface 38 is threaded and the tube 32 extends through the hinge body 16 such that the tube 32 extends along a vertical axis when the legs 26 are stood on the horizontal support surface 14. The upper end 28 of the tube 32 is spaced upwardly from the hinge body 16 and a nut 40 threadably engages the outer surface 38 of the tube 32. A panel 42 is provided and the panel 42 is positionable on the horizontal support surface 14 adjacent to the tripod 12. The panel 42 has a perimeter edge 44, the perimeter edge 44 has four corners 46 and a respective pair of the four corners 46 has a notch 48 extending toward a center of the panel 42. The notch 48 on each of the pair of corners 46 accommodates a respective one of the legs 26 that are pivotally disposed on the lateral hinge points 20 when the respective legs 26 are positioned in the deployed position.

A shock absorber 50 is slidably integrated into the tripod 12 and the shock absorber 50 is positionable at an adjustable height on the tripod 12. The shock absorber 50 comprises a shock member 52 that has a top end 54 and a bottom end 56. The shock member 52 extends through the tube 32 having the top end 54 of the shock member 52 being spaced upwardly form the upper end 34 of the tube 32 and having the bottom end 56 of the shock member 52 being spaced from the lower end 36 of the tube 32. The nut 40 tightens against the shock member 52 when the nut 40 is tightened for retaining the top end 54 of the shock member 52 a desired distance from the upper end 28 of the tube 32.

The shock absorber 50 includes a cup 58 that has a top wall 60 and an outside wall 62 defining an opening 64 into the cup 58. The outside wall 62 has a diameter is sufficient to insertably receive the top end 54 of the shock member 52. The shock absorber 50 includes a biasing member 66 that is positioned between the top wall 60 of the cup 58 and the top end 54 of the shock member 52 such that the biasing member 66 biases the top wall 60 away from the top end 54. The biasing member 66 absorbs vibration imparted in the cup 58 thereby inhibiting the vibration from being communicated to the shock member 52.

An armature 68 is attached to the shock absorber 50 thereby facilitating the armature 68 to be positioned at an adjustable height on the tripod 12. The armature 68 is positionable in a gripping orientation having the armature 68 extending laterally away from the tripod 12 thereby facilitating the armature 68 to extend over a door 70 that is being painted. The door 70 may be an interior door of a house, an exterior door of a house or other type of panelized door. The armature 68 has a gripping element 72 thereby facilitating the gripping element 72 to engage the door 70 to retain the door 70 in a vertical orientation. In this way the armature 68 facilitates a front 74 of the door 70 and a back 76 of the door 70 to be painted without having to reposition the door 70. The shock absorber 50 absorbs vibration from the door 70 resulting from the force of paint 77 from a pressurized spray gun thereby inhibiting the tripod 12 from being affected by the vibration. In this way the tripod 12 does not become unstable from the vibration while the door 70 is being sprayed with paint 77.

The armature 68 comprises a pivot 78 that has a bottom end 80 and a top end 82, and the bottom end 80 of the pivot 78 is coupled to the top wall 60 of the cup 58 of the shock absorber 50. Additionally, the top end 82 of the pivot 78 has a notch 84 extending toward the bottom end 80 of the pivot 78. The armature 68 includes a pole 86 that has a first end 88 and a second end 90. The pole 86 is elongated between the first end 88 and the second end 90, and the second end 90 is positioned in the notch 84 in the top end 82 of the pivot 78. The armature 68 includes a pin 92 extending through the pivot 78 and the pole 86 for pivotally attaching the pole 86 to the pivot 78. The pole 86 is positionable in a deployed position having the pole 86 being perpendicularly oriented with an axis extending through the top end 82 and the bottom end 80 of the pivot 78 thereby facilitating the pole 86 to extend over the door 70. Conversely, the pole 86 is positionable in a stored position having the pole 86 being oriented collinear with the axis.

The gripping element 72 comprises an end cap 94 that is attached to the first end 88 of the pole 86, and the end cap 94 has an outside surface 96. The gripping element 72 includes a grip 98 that is coupled to and extends away from the outside surface 96 of the end cap 94. The grip 98 has a front edge 100, a rear edge 102 and a distal end 104 with respect to the outside surface 96, and the grip 98 tapers to a point at the distal end 104. The front edge 100 is perpendicularly oriented with a lengthwise axis of the pole 86 and the rear edge 102 is oriented at a non-perpendicular angle with the lengthwise axis. The shock member 52 is positioned at an appropriate height to facilitate the distal end 104 of the grip 98 to engage a top edge 106 of the door 70.

In use, the legs 26 of the tripod 12 are positioned in the deployed position and the panel 42 is placed against the respective pair of legs 26 to stabilize the respective pair of legs 26. The door 70 is stood on the horizontal support surface 14 and the shock absorber 50 is adjusted to an appropriate height to facilitate the gripping element 72 to engage the top edge 106 of the door 70. The nut 40 is tightened to retain the shock absorber 50 at the desired height. In this way the door 70 is retained in a horizontal orientation to facilitate the front 74 side and the back 76 side of the door 70 to be painted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A door painting assembly for holding a door in a vertical orientation for painting the door, said assembly comprising:

a tripod being positionable on a horizontal support surface such that said tripod is vertically oriented;

a shock absorber being slidably integrated into said tripod, said shock absorber being positionable at an adjustable height on said tripod;

an armature being attached to said shock absorber thereby facilitating said armature to be positioned at an adjustable height on said tripod, said armature being positionable in a gripping orientation having said armature extending laterally away from said tripod thereby facilitating said armature to extend over a door being painted, said armature having a gripping element thereby facilitating said gripping element to engage the door to retain the door in a vertical orientation wherein said armature is configured to facilitate a front of the door and a back of the door to be painted without having to reposition the door, said shock absorber absorbing vibration from the door resulting from the force of paint from a pressurized spray gun thereby inhibiting said tripod from being affected by the vibration; and wherein said tripod comprises:

a hinge body having a plurality of hinge points extending away from a center of said hinge body, said plurality of hinge points including a pair of lateral hinge points and a rear hinge point, each of said lateral hinge points being aligned with a front face of said hinge body, said rear hinge point being centrally positioned between said lateral hinge points, said rear hinge point extending away from said pair of lateral hinge points;

a plurality of legs, each of said legs having an upper end and a lower end, said upper end of each of said legs being pivotally engaged to a respective one of said lateral and rear hinge points on said hinge body, each of said legs being positionable in a deployed position having each of said legs angling outwardly from said respective hinge point, each of said legs being positionable in a stored position having each of said legs extending downwardly from said respective hinge point;

a tube having an upper end, a lower end and an outer surface extending between said upper end and said lower end of said tube, said outer surface being threaded, said tube extending through said hinge body such that said tube extends along a vertical axis when said legs are stood on the horizontal support surface, said upper end of said tube being spaced upwardly from said hinge body; and a nut threadably engaging said outer surface of said tube.

2. The assembly according to claim 1, further comprising a panel being positionable on the horizontal support surface adjacent to said tripod, said panel having a perimeter edge, said perimeter edge having four corners, a respective pair of said four corners having a notch extending toward a center of said panel, said notch on each of said pair of corners accommodating a respective one of said legs that are pivotally disposed on said lateral hinge points when said respective legs are positioned in said deployed position.

3. The assembly according to claim 1, wherein said shock absorber comprises:

a shock member having a top end and a bottom end, said shock member extending through said tube having said top end of said shock member being spaced upwardly form said upper end of said tube and having said bottom end of said shock member being spaced from said lower end of said tube, said nut tightening against said shock member when said nut is tightened for retaining said top end of said shock member a desired distance from said upper end of said tube;

a cup having a top wall and an outside wall defining an opening into said cup, said outside wall having a diameter being sufficient to insertably receive said top end of said shock member; and a biasing member being positioned between said top wall of said cup and said top end of said shock member such that said biasing member biases said top wall away form said top end, said biasing member absorbing vibration imparted in said cup thereby inhibiting the vibration from being communicated to said shock member.

4. The assembly according to claim 3, wherein said armature comprises a pivot having a bottom end and a top end, said bottom end of said pivot being coupled to said top wall of said cup of said shock absorber, said top end of said pivot having a notch extending toward said bottom end of said pivot.

5. The assembly according to claim 4, further comprising:

a pole having a first end and a second end, said pole being elongated between said first end and said second end, said second end being positioned in said notch in said top end of said pivot;

a pin extending through said pivot and said pole for pivotally attaching said pole to said pivot, said pole being positionable in a deployed position having said pole being perpendicularly oriented with an axis extending through said top end and said bottom end of said pivot thereby facilitating said pole to extend over the door, said pole being positionable in a stored position having said pole being oriented collinear with said axis.

6. The assembly according to claim 5, wherein said gripping element comprises:

an end cap being attached to said first end of said pole, said end cap having an outside surface; and a grip being coupled to and extending away from said outside surface of said end cap, said grip having a front edge, a rear edge and a distal end with respect to said outside surface, said grip tapering to a point at said distal end, said front edge being perpendicularly oriented with a lengthwise axis of said pole, said rear edge being oriented at a non-perpendicular angle with said lengthwise axis, said shock member being positioned at an appropriate height to facilitate said distal end of said grip to engage a top edge of the door.

7. A door painting assembly for holding a door in a vertical orientation for painting the door, said assembly comprising:

a tripod being positionable on a horizontal support surface such that said tripod is vertically oriented, said tripod comprising:

a hinge body having a plurality of hinge points extending away from a center of said hinge body, said plurality of hinge points including a pair of lateral hinge points and a rear hinge point, each of said lateral hinge points being aligned with a front face of said hinge body, said rear hinge point being centrally positioned between said lateral hinge points, said rear hinge point extending away from said pair of lateral hinge points;

a plurality of legs, each of said legs having an upper end and a lower end, said upper end of each of said legs being pivotally engaged to a respective one of said lateral and rear hinge points on said hinge body, each of said legs being positionable in a deployed position having each of said legs angling outwardly from said respective hinge point, each of said legs being positionable in a stored position having each of said legs extending downwardly from said respective hinge point;

a tube having an upper end, a lower end and an outer surface extending between said upper end and said lower end of said tube, said outer surface being threaded; said tube extending through said hinge body such that said tube extends along a vertical axis when said legs are stood on the horizontal support surface, said upper end of said tube being spaced upwardly from said hinge body; and a nut threadably engaging said outer surface of said tube;

a panel being positionable on the horizontal support surface adjacent to said tripod, said panel having a perimeter edge, said perimeter edge having four corners, a respective pair of said four corners having a notch extending toward a center of said panel, said notch on each of said pair of corners accommodating a respective one of said legs that are pivotally disposed on said lateral hinge points when said respective legs are positioned in said deployed position;

a shock absorber being slidably integrated into said tripod, said shock absorber being positionable at an adjustable height on said tripod, said shock absorber comprising:

a shock member having a top end and a bottom end, said shock member extending through said tube having said top end of said shock member being spaced upwardly form said upper end of said tube and having said bottom end of said shock member being spaced from said lower end of said tube, said nut tightening against said shock member when said nut is tightened for retaining said top end of said shock member a desired distance from said upper end of said tube;

a cup having a top wall and an outside wall defining an opening into said cup, said outside wall having a diameter being sufficient to insertably receive said top end of said shock member; and a biasing member being positioned between said top wall of said cup and said top end of said shock member such that said biasing member biases said top wall away form said top end, said biasing member absorbing vibration imparted in said cup thereby inhibiting the vibration from being communicated to said shock member; and an armature being attached to said shock absorber thereby facilitating said armature to be positioned at an adjustable height on said tripod, said armature being positionable in a gripping orientation having said armature extending laterally away from said tripod thereby facilitating said armature to extend over a door being painted, said armature having a gripping element thereby facilitating said gripping element to engage the door to retain the door in a vertical orientation wherein said armature is configured to facilitate a front of the door and a back of the door to be painted without having to reposition the door, said shock absorber absorbing vibration from the door resulting from the force of paint from a pressurized spray gun thereby inhibiting said tripod from being affected by the vibration, said armature comprising:

a pivot having a bottom end and a top end, said bottom end of said pivot being coupled to said top wall of said cup of said shock absorber, said top end of said pivot having a notch extending toward said bottom end of said pivot;

a pole having a first end and a second end, said pole being elongated between said first end and said second end, said second end being positioned in said notch in said top end of said pivot;

a pin extending through said pivot and said pole for pivotally attaching said pole to said pivot, said pole being positionable in a deployed position having said pole being perpendicularly oriented with an axis extending through said top end and said bottom end of said pivot thereby facilitating said pole to extend over the door, said pole being positionable in a stored position having said pole being oriented collinear with said axis; and wherein said gripping element comprises:

an end cap being attached to said first end of said pole, said end cap having an outside surface; and a grip being coupled to and extending away from said outside surface of said end cap, said grip having a front edge, a rear edge and a distal end with respect to said outside surface, said grip tapering to a point at said distal end, said front edge being perpendicularly oriented with a lengthwise axis of said pole, said rear edge being oriented at a non-perpendicular angle with said lengthwise axis, said shock member being positioned at an appropriate height to facilitate said distal end of said grip to engage a top edge of the door.

* * * * *